US008240474B1

(12) United States Patent
Mossberg et al.

(10) Patent No.: US 8,240,474 B1
(45) Date of Patent: Aug. 14, 2012

(54) PACKAGING ARTICLE FOR RECTANGULAR OBJECTS

(75) Inventors: Thomas W. Mossberg, Eugene, OR (US); Dmitri Iazikov, Eugene, OR (US); Christoph M. Greiner, Eugene, OR (US)

(73) Assignee: LightSmyth Technologies Inc., Eugene, OR (US)

( * ) Notice: Subject to any disclaimer, the term of this patent is extended or adjusted under 35 U.S.C. 154(b) by 0 days.

(21) Appl. No.: 13/013,797

(22) Filed: Jan. 25, 2011

Related U.S. Application Data

(60) Provisional application No. 61/298,181, filed on Jan. 25, 2010.

(51) Int. Cl.

| | |
|---|---|
| ***B65D 81/02*** | (2006.01) |
| ***B65D 1/36*** | (2006.01) |
| ***B65D 6/04*** | (2006.01) |
| ***B65D 85/30*** | (2006.01) |

(52) U.S. Cl. ..... 206/449; 206/486; 206/526; 206/564; 206/589

(58) Field of Classification Search ..... 206/0.83, 206/0.84, 445, 449, 486–489, 526, 557–565, 206/588–590

See application file for complete search history.

(56) References Cited

U.S. PATENT DOCUMENTS

| | | | | | |
|---|---|---|---|---|---|
| 3,139,977 | A | * | 7/1964 | Burdick | 206/0.83 |
| 3,469,686 | A | * | 9/1969 | Gutsche et al. | 206/564 |
| 3,482,682 | A | * | 12/1969 | Cronkhite | 229/406 |
| 3,589,511 | A | * | 6/1971 | Britt | 206/564 |
| 3,661,253 | A | * | 5/1972 | Cronkhite | 229/406 |
| 3,672,495 | A | * | 6/1972 | Bauer et al. | 206/558 |
| 4,248,349 | A | * | 2/1981 | Locke et al. | 206/561 |

* cited by examiner

*Primary Examiner* — Bryon Gehman
(74) *Attorney, Agent, or Firm* — David S. Alavi

(57) ABSTRACT

A packaging article comprises first and second packaging members with one or more depressions and corresponding protrusions, respectively, and can be assembled with their each protrusion received within the corresponding depression. A transverse cross section of each depression is concave. A transverse cross section of each protrusion includes a secondary protrusion that forms a longitudinal ridge; a longitudinal cross section of the ridge comprises one or more concavities. A substantially rectangular object is place in a depression and the first and second packaging members are assembled. The object, received within the depression and located between the assembled packaging members, rests with two opposing edges of the object urged against the concave surface of the depression with corresponding lines of contact oriented substantially longitudinally, and with two other opposing edges of the object urged against the concavity.

23 Claims, 6 Drawing Sheets

PACKAGING ARTICLE FOR RECTANGULAR OBJECTS

BENEFIT CLAIMS TO RELATED APPLICATIONS

This application claims benefit of U.S. Provisional App. No. 61/298,181 filed Jan. 25, 2010 in the names of Thomas W. Mossberg, Dmitri lazikov, and Christoph M. Greiner, said provisional application being incorporated by reference as if fully set forth herein.

BACKGROUND

The field of the present invention relates to packaging of thin rectangular items. In particular, a packaging article is disclosed for providing support of thin, fragile rectangular parts, e.g., optical components, of various sizes by contact with only the edges of the parts, so as to prevent damage or contamination of the faces of the parts by contact with the packaging article.

In a package employed for transporting a fragile or delicate item or part, it is typically preferred that the item be held immobile. If contact with surfaces of the part can soil, damage, or otherwise degrade the item, the item is preferably held immobile by contact with only its edges.

In the case of thick parts, conventional packages have been developed that utilize edge contact to hold the part immobile while touching only edges. For example, a plastic sheet can be vacuum molded so as to exhibit a depression (of a suitable shape, such as a rectangular slot) that is slightly larger than the part to be held. The sides of the depression can slope down at less than 90 degrees so that the closed bottom of the depression is slightly smaller than the piece to be held. The thick part is inserted into the depression until friction with the sloped wall (against the part's sides) holds it securely immobilized. By creating one or more such molded depressions on a sheet of plastic and molding the edges of the plastic sheet to fit within an enclosure such as a box (plastic, paper or cardboard, or other suitable box material), a useful package can be provided that holds sensitive parts immobile and makes contact with only the edges of the parts. Typically, the edges of the molded sheet would be shaped so as to hold the depressions above the bottom of the box.

Such a packaging arrangement, which is in use currently, has several disadvantages. First, the depressions involved must have at least one dimension nearly identical to the parts to be packaged. As a result, it may be necessary to inventory many different packaging articles in order to accommodate an array of part sizes. Second, the depression packaging approach does not work well for thin parts. Thin parts are prone to rotating or tilting within the depression and losing frictional engagement with its sloped side walls. Should this happen, the part is no longer immobilized and one or more of its surfaces can come into contact with the packaging material, causing damage, contamination, or other degradation.

SUMMARY

A packaging article comprises first and second packaging members. The first packaging member has one or more depressions on its first surface, and the second packaging member has one or more protrusions on its first surface. The first and second packaging members are arranged to be assembled together with their respective first surfaces facing one another and with each protrusion of the second packaging member at least partly received within a corresponding depression of the first packaging member. A transverse cross section of each depression is concave. A transverse cross section of each protrusion includes a secondary protrusion. The secondary protrusion forms a longitudinal ridge on the corresponding protrusion, and a longitudinal cross section of the ridge comprises a series of one or more concavities arranged along the length of the protrusion.

A method comprises placing a substantially rectangular object in one of the depressions of the first packaging member, and assembling the second packaging member onto the first packaging member with their first surfaces facing one another. The depressions and concavities of the corresponding protrusion are arranged so that the object, received within the depression and located between the assembled packaging members, rests with two opposing edges of the object urged against the concave surface of the depression with corresponding lines of contact oriented substantially longitudinally, and with two other opposing edges of the object urged against the concavity.

Objects and advantages pertaining to packaging articles may become apparent upon referring to the exemplary embodiments illustrated in the drawings and disclosed in the following written description or appended claims.

Figure 2A:
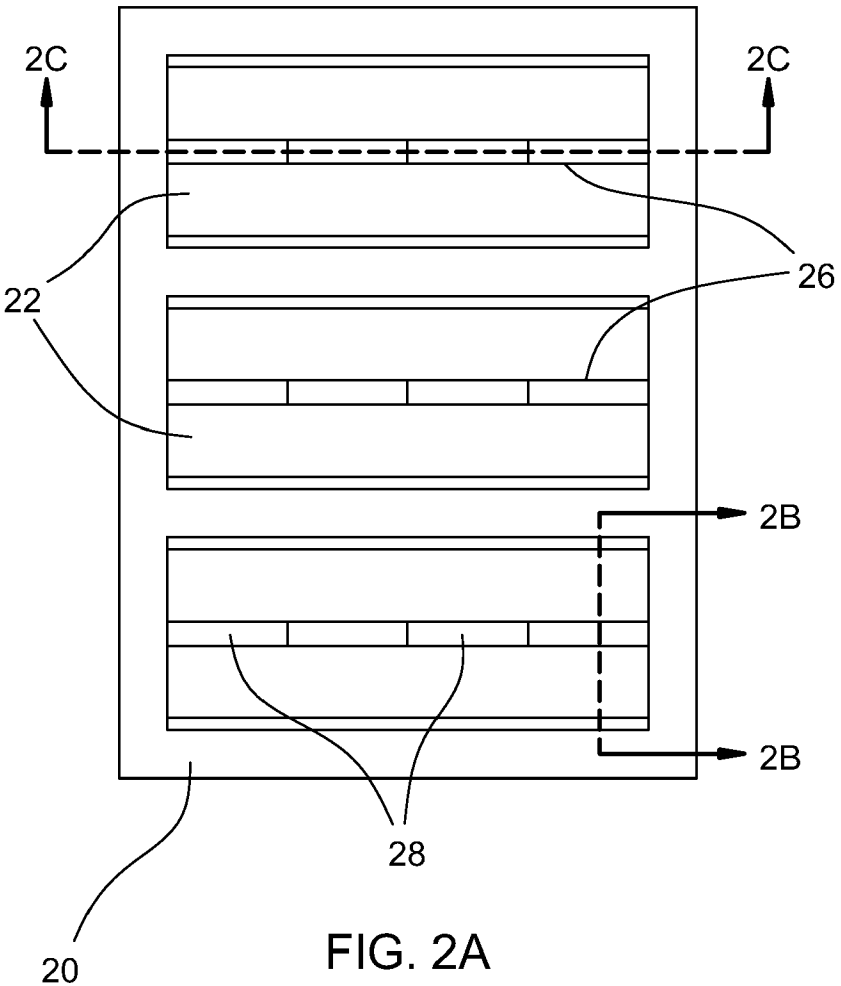
FIGS. 2A-2D are schematic plan, transverse cross section, longitudinal cross section, and isometric views of a second packaging member of the exemplary packaging article.
Figure 2C:
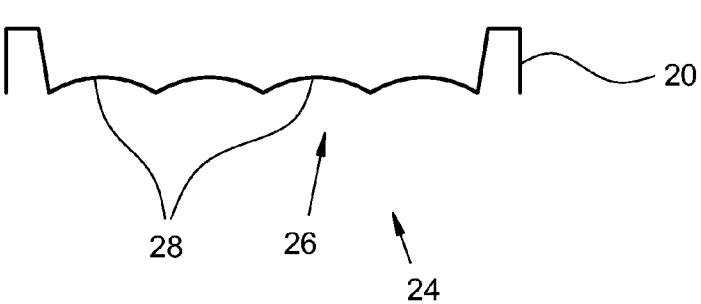

It should be noted that the embodiments depicted in this disclosure are shown only schematically, and that not all features may be shown in full detail or in proper proportion. Certain features or structures may be exaggerated relative to others for clarity. It should be further noted that the embodiments shown are exemplary only, and should not be construed as limiting the scope of the written description or appended claims.

DETAILED DESCRIPTION OF EMBODIMENTS

A packaging article is illustrated schematically in the drawings and comprises a first packaging member 10 and a second packaging member 20. The first packaging member 10 (FIGS. 1A-1D) has one or more depressions 12 on its first surface 14; the second packaging member 20 (FIGS. 2A-2D) has one or more protrusions 22 on its first surface 24. The first and second packaging members 10 and 20 are arranged to be assembled together (i) with their respective first surfaces 14 and 24 facing one another and (ii) with each protrusion 22 of the second packaging member 20 at least partly received within a corresponding depression 12 of the first packaging member 10 (illustrated schematically in FIGS. 3A, 3B, 4A, 4B, and 5).

Figure 1A:
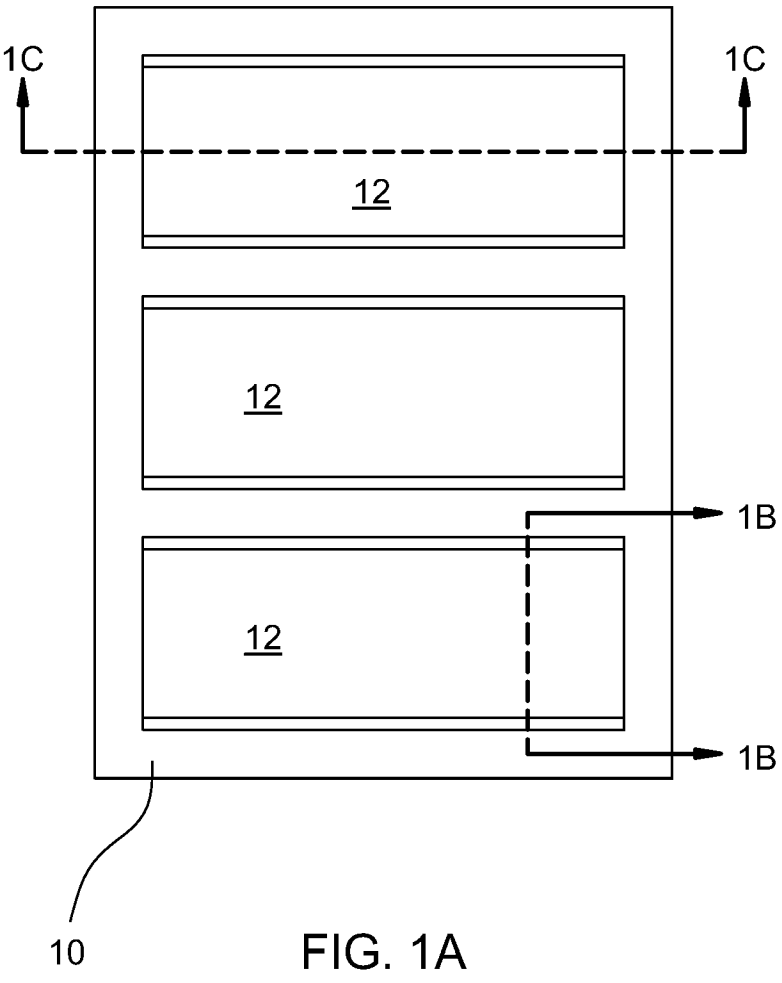
FIGS. 1A-1D are schematic plan, transverse cross section, longitudinal cross section, and isometric views of a first packaging member of an exemplary packaging article.
Figure 1C:
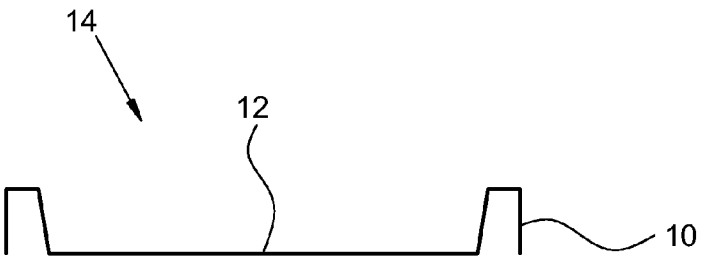
Figure 2B:
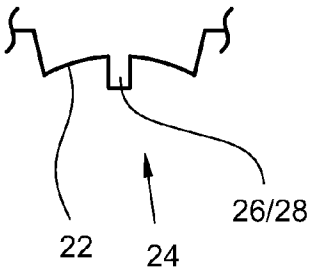
Figure 1B:
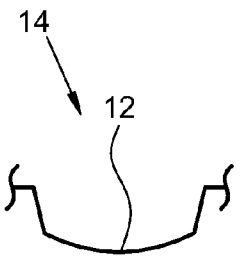
Figure 3B:
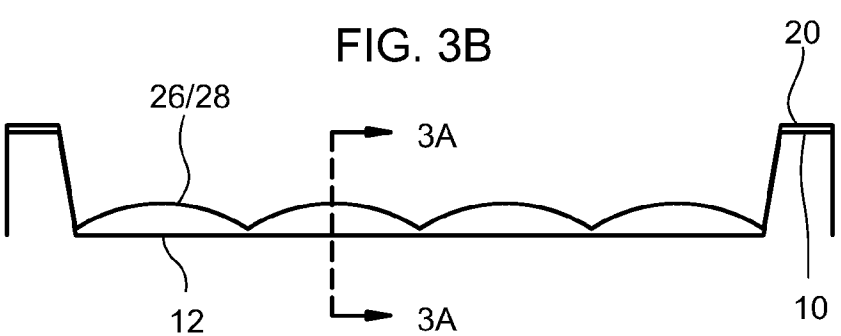
FIGS. 3A and 3B are schematic transverse and longitudinal cross sections, respectively, of a portion of the assembled packaging article without an object between them.
Figure 4B:
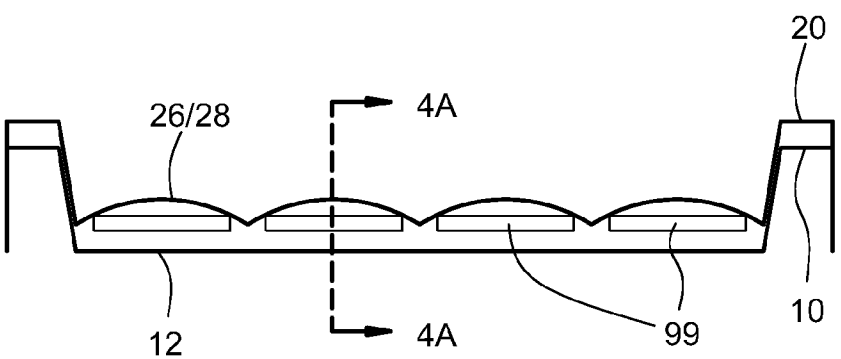
FIGS. 4A and 4B are schematic transverse and longitudinal cross sections, respectively, of a portion of the assembled packaging article with an object between them.
Figure 3A:
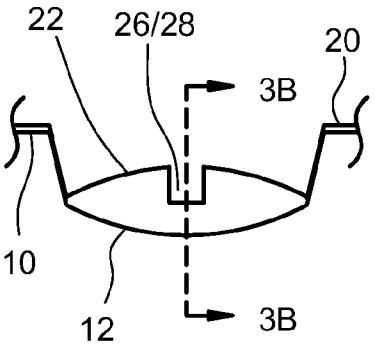
Figure 4A:
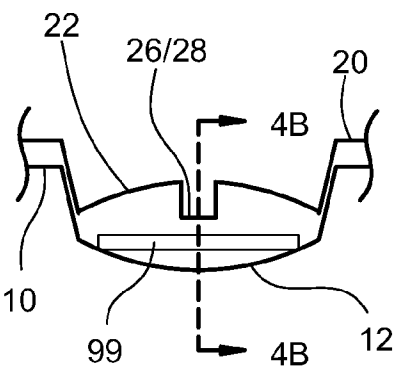

A transverse cross section of each depression 12 is concave (as shown in FIGS. 1B, 3A, and 4A); the cross section can be substantially constant along a longitudinal direction orthogonal to the transverse cross section (as shown FIGS. 1C, 3B, and 4B). The depressions 12 (and protrusion 22) can be elongated in the longitudinal direction, but this need not be the case; the designations "transverse" and "longitudinal" refer only to directions relative to the cross sections of FIGS. 1B, 1C, 2B, and 2C, which may or may not coincide with the long and short dimensions of an elongated depression or protrusion. The concave transverse cross section shown in FIG. 1B is curved, but any generally concave shape can be employed, e.g., circular, elliptical, otherwise curved, V-shaped, trapezoidal, or otherwise polygonal. A rectangular object 99 can rest within the depression 12 with opposing edges thereof supported by the concave surface of the depression 12, with corresponding lines of contact 98 between each edge and the concave surface oriented substantially longitudinally (illustrated schematically in FIGS. 4A and 5; bold lines indicate edge contact in FIG. 5). The concave transverse cross section of the depressions 12 enable rectangular objects of various sizes to be supported by the concave surface. A smaller object 99 rests at a position lower within the depression 12 than a larger object, with the corresponding lines of contact 98 closer together than those of a larger object. A cross section that is curved, or that is polygonal with segments no longer than the shortest edge of the smallest object to be packaged, can be preferred, because such a cross section substantially eliminates the possibility of face-to-face contact between a flat surface of the object 99 and a surface of the depression 12.

A transverse cross section of each protrusion 22 (as shown in FIGS. 2B, 3A, and 4A) includes a secondary protrusion, which forms a longitudinal ridge 26 on the corresponding protrusion 22. A longitudinal cross section of the ridge 26 (FIGS. 2D, 3B, and 4B) comprises a series of one or more concavities 28 arranged along the length of the protrusion 22.

To use the packaging article, a substantially rectangular object 99 is first placed in a depression 12 of the first packaging member 10. The second packaging member 20 is then assembled with the first packaging member with their respective first surfaces 14 and 24 facing one another, and with the object 99 between them. The object 99 is located within the depression 12 at a position along the longitudinal direction that substantially aligns the object 99 with one of the concavities 28.

Figure 5:
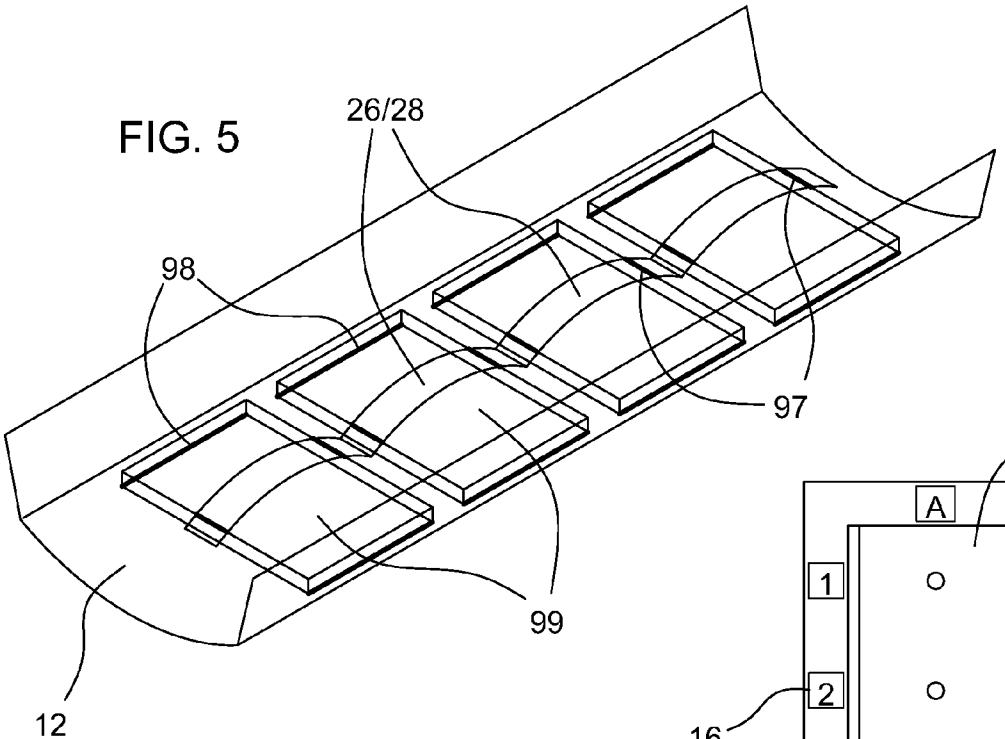
FIG. 5 is a schematic isometric transparent view of a portion of the assembled packaging article with several objects between them.

As illustrated schematically in FIGS. 4B and 5, the concavities 28 of the corresponding protrusion 22 are arranged so that, upon assembly of the first and second packaging members 10 and 20 with the object 99 located within the depression 12 as described above, two opposing edges of the object 99 (not the edges in contact with the depression 12, but the two other opposing edges) are urged against the concavity 28 at lines of contact 97 (FIGS. 4B and 5; bold lines indicate edge contact in FIG. 5). The description of the object as "substantially aligned" with the concavity is intended indicate a position of the object 99 within the depression 12 that enables such engagement of the two opposing edges by the concavity 28. That arrangement ensures that the object 99 is held substantially immobile when it is located between and engaged with the assembled packaging members 10 and 20. The arrangement of the concave depression 12 and the concavities 28 ensure that contact between the object 99 and the packaging members 10 and 20 occurs along contact lines 97 and 98 only at the edges of the object 99 (bold lines in FIG. 5), thereby protecting the surfaces of the object 99 from contamination, damage, or other degradation that might result from contact with the packaging members 10 or 20.

The immobilization and edge-only contact can be achieved even if the object 99 is tilted relative to the packaging member 10. The concave transverse cross section of the depression 12 allows the object to be supported by two parallel lines of contact 98 with the depression 12 despite being tilted, and engagement of the other two opposing edges with the concavity 28 along lines of contact 97 can hold the object 99 substantially immobilized in the depression 12 despite being tilted, even if the object 99 is quite thin. The concavities 28 enable a degree of "self-centering" of the object 99 along the longitudinal direction if the object 99 is not initially aligned with the concavity 28, by causing the object 99 to move along the depression 12 when the packaging members 10 and 20 are assembled.

In some instances, the first packaging member 10 or the second packaging member 20 (or both) can comprise a deformable packaging member arranged so as to deform when the first and second packaging members 10 and 20 are assembled together with the object 99 located and engaged between them. That deformation can enable a wider range of sizes of thicknesses of the object 99 to be accommodated, can enhance the immobilization of the object 99 by urging the object against the depression 12 and concavity 28, or can limit the force exerted by the assembled packaging members 10 and 20 on the object 99 (to reduce the likelihood of damage or breakage of the object). The deformable packaging member can comprise a resilient (i.e., elastically deformable) packaging member, if needed or desired.

In some embodiments of the packaging article, one or both of the first or second packaging members 10 or 20 comprise a molded plastic sheet. The plastic sheet can be deformable or resilient. In any molded-sheet embodiment (plastic or otherwise), the depressions 12 on the first surface 14 of the first packaging member 10 correspond to complimentary protrusions on its second surface, and the protrusions 22 on the first surface 24 of the second packaging member 20 correspond to complimentary depressions on its second surface. In other embodiments, the second surfaces of the packaging members 10 and 20 do not necessarily include complimentary protrusions or depressions, respectively. The packaging members 10 and 20 can comprise any suitable or desirable material, including but not limited to plastic, metal, cardboard, glass, ceramic, wood or other material. It may be desirable to employ a transparent or translucent material for one or both of the packaging members 10 or 20, to enable visualization of the objects 99 located and engaged between them for inspecting, counting, or simply ascertaining the presence of the objects 99.

Figures 1D, 2D:
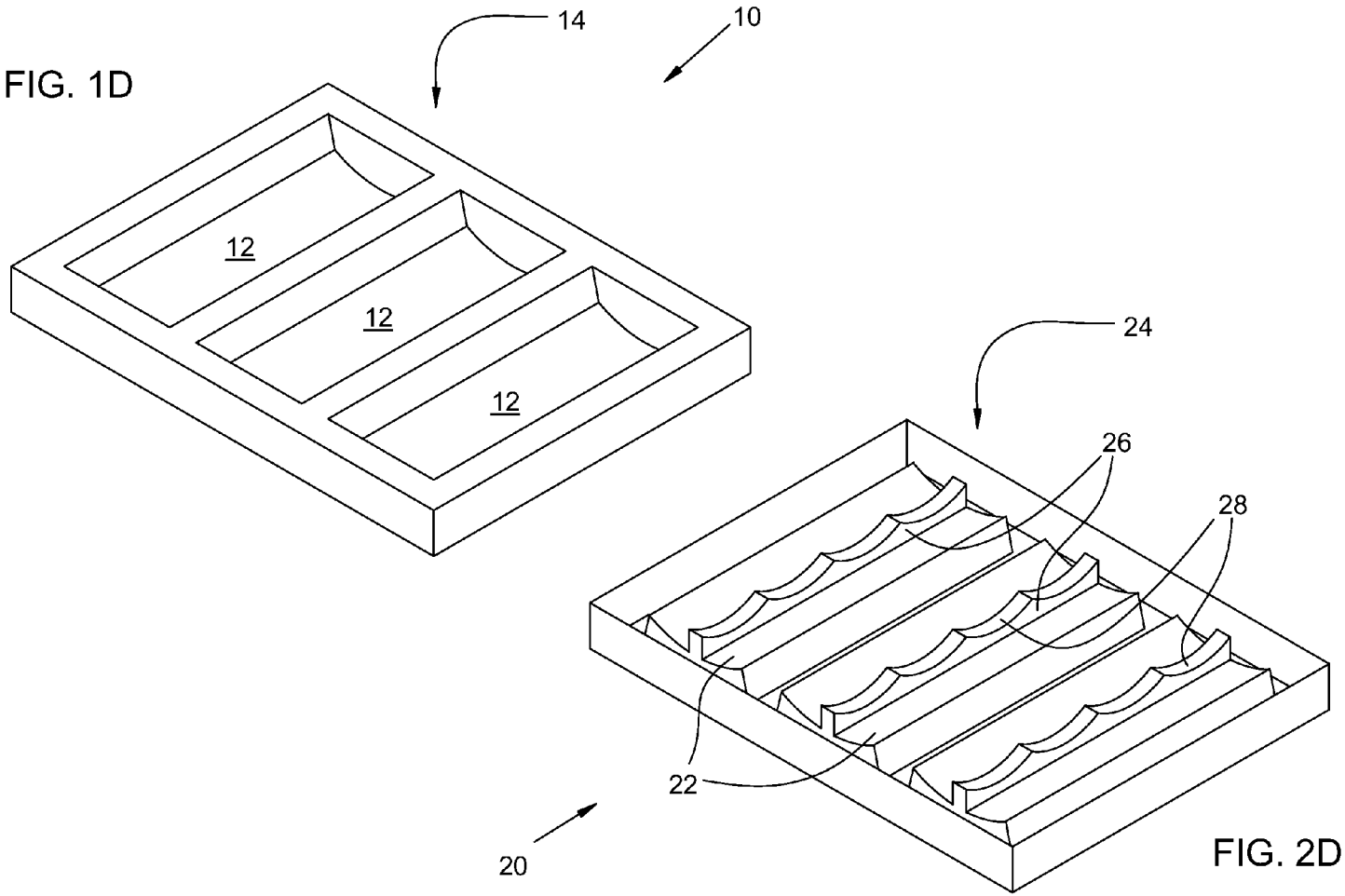

The first and second packaging members 10 and 20 can comprise structurally discrete, separate members that are assembled together (as in FIGS. 1D and 2D). Alternatively, the first and second packaging members 10 and 20 can be connected together in a way that enables (i) access to the depressions 12 for placing the objects therein and (ii) assembly of the packaging members 10 and 20 as disclosed above. For example, both packaging members can be formed from a single molded plastic sheet, and the sheet can then be folded over to assemble the packaging members with the object located and engaged between them. In another example, initially separate packaging members can be connected by a hinge or other similar mechanism.

Figure 7:
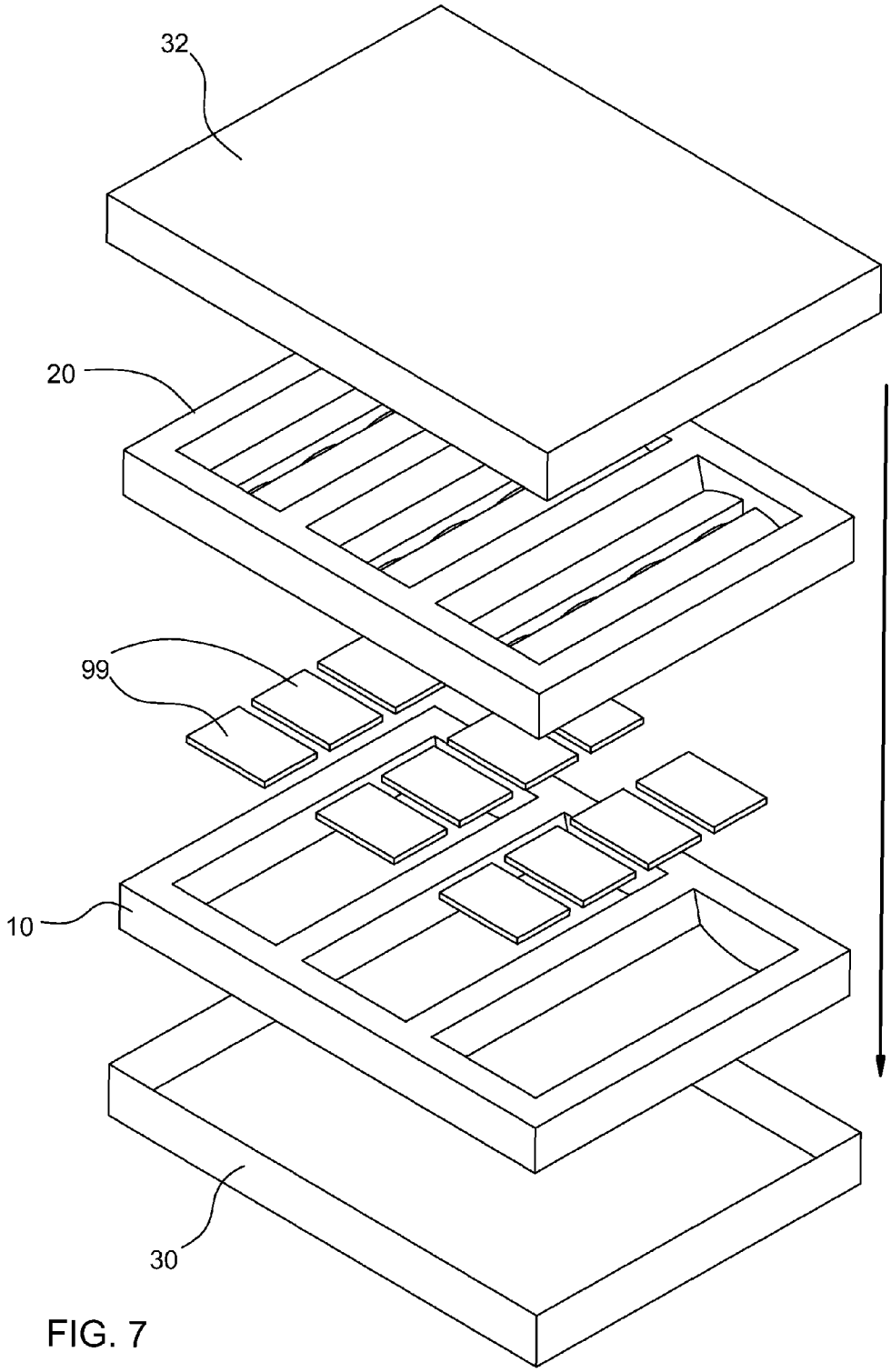
FIG. 7 is a schematic exploded view of an exemplary packaging article, a box, and objects to be packaged.

The packaging article is typically, but not necessarily, used with a box or other container. As illustrated schematically in the example of FIG. 7, the box can comprise a box bottom 30 arranged to receive or retain the assembled first and second packaging members 10 and 20 with the object 99 located and engaged between them. The box bottom 30 can be arranged to engage one or both packaging members to retain them in the box, e.g., by a friction or interference fit, by a tab or other retaining mechanism of any suitable type, by suitable tape or other adhesive, or by presence of a lid. The box can include a lid arranged to enclose the assembled first and second packaging members 10 and 20 received within the box bottom 30. The lid can be implemented as one or more hinged or folding members attached to the box bottom 30, or (as in the example of FIG. 7) can comprise a separate lid 32 arranged to fit onto the box bottom 30. The box and lid can comprise any suitable material, including but not limited to cardboard, plastic, metal, glass, ceramic, wood, or other material. Whether or not a box is employed, the first and second packaging members 10 and 20, with one or more objects 99 located and engaged between them, can be held together, e.g., with tape or other adhesive, with string, ribbon, or band, by insertion into a sleeve, by wrapping in flexible sheet or film, or by other suitable or convenient arrangement.

In some exemplary embodiments, the packaging member 10 can include only one depression 12 and the packaging member 20 can include only one protrusion 22; in other exemplary embodiments, the packaging member 10 can include multiple depressions 12 and the packaging member 20 can include multiple corresponding protrusions 22. Whether one or multiple depressions 12 and protrusions 22 are present, the depression(s) 12 can be sized to accommodate only one object 99 and each corresponding protrusion(s) 22 can include only a single concavity 28; alternatively, the depression(s) 12 can be sized to accommodate multiple objects 99 and each corresponding protrusion(s) 22 can include multiple concavities 28. If multiple depressions 12 are present, they can be substantially identical or can differ from one another in any suitable respect (e.g., length, depth, or cross section). If multiple protrusions 22 are present, they can be substantially identical or can differ from one another in any suitable respect (e.g., length, height, cross section, or number or size of concavities). If multiple concavities 28 are present in a given protrusion 22, they can be substantially identical or can differ from one another in any suitable respect (e.g., length, height, or cross section). In the examples in the drawings, three substantially identical depressions 12 are each arranged to receive four objects 99, each received in one of four substantially identical concavities 28. Any suitable or desired number of depressions 12 and corresponding protrusions 22, and any suitable or desired number of concavities 28 in each protrusion 22, can be employed to package any suitable or desired number of objects 99. The depressions 12 and protrusions 22 can be arranged in any suitable, desirable, or convenient arrangement on the packaging members 10 and 20, respectively.

In a particular exemplary embodiment, the first packaging member 10 comprises a vacuum formed plastic sheet that is inserted first into a plastic box 30 that is 4⅝ inches long by 3½ inches wide. The edges of the formed sheet are molded downward to fit against the sides of the plastic box 30 and hold the first packaging member 10 snuggly in place in the box 30. Three depressions 12 with curved bottoms are sized to hold four objects 99 each. The second packaging member 20 also comprises a vacuum formed plastic sheet that is placed down onto the first packaging member 10 in the box. The three protrusions 22 correspond to the three depressions 12, and each protrusion 22 includes a ridge 26 with four concavities 28. The exemplary packaging member therefore can hold up to twelve objects 99.

In the particular embodiment described above, the packaging members are vacuum-formed from thin plastic sheets about 1 to 6 mils in thickness, i.e., about 0.001-0.006 inches thick. However, the packaging members 10 and 20 can be formed with other materials or by other suitable processes. For example, the packaging members 10 and 20 can be formed by stamping, injection molding, or other forming method known in the art. They can be formed from thin sheets, or can be solid with exterior profiles (i.e., depression or protrusions) as described above.

If the packaging article is to be used with only a specific part size, the height of the protrusions 22 can be chosen so that the ridges 26 touch the bottom of depressions 12 when the packaging members 10 and 20 are assembled together with the objects 99 located and engaged between them; alternatively, the packaging members 10 and 20 can be arranged so that their first surfaces meet with the concavities 28 separated from the bottom of the depressions 12 by a desired distance. In either of those examples, downward pressure on the objects can be precisely controlled for objects of a particular size, which can be useful when the objects are quite thin and potentially fragile (e.g., glass, silica, or semiconductor objects 10 or more millimeters wide and long but less than 1 millimeter thick). In more general examples, where the ridges 26 do not reach the bottom of the depressions 12 with the objects 99 in place, care should be exercised not to apply undue downward force on the objects, or only objects sufficiently robust to withstand such downward force should be packaged. Use of deformable or resilient materials to form the packaging members 10 or 20 can mitigate such concerns, as described above.

Figure 6:
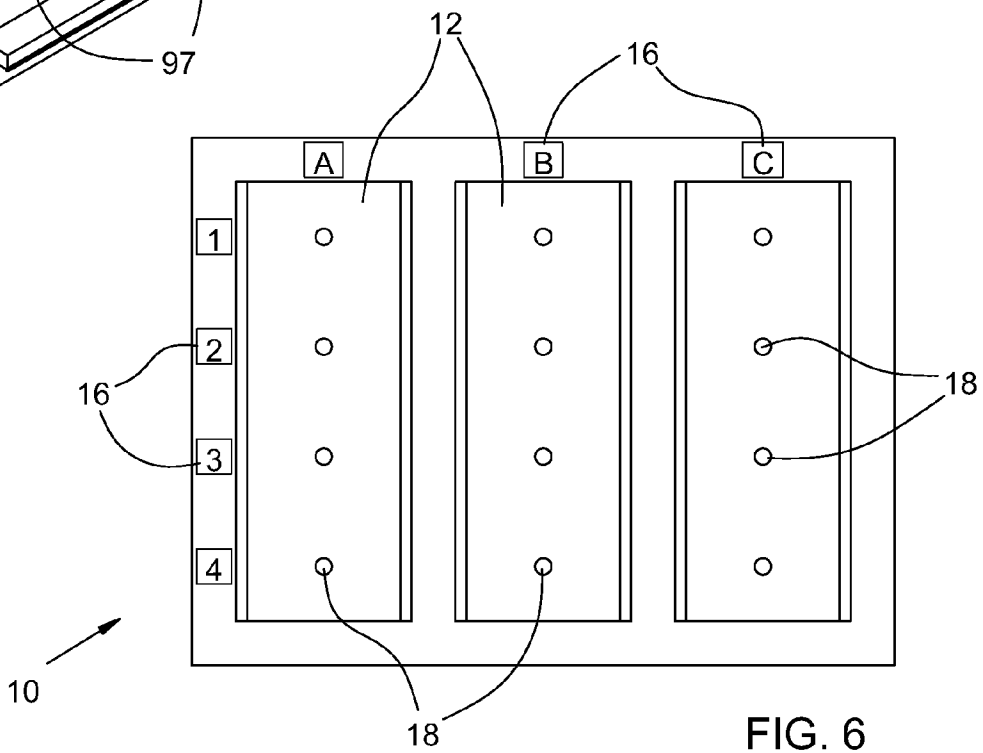
FIG. 6 is a schematic plan view of a first packaging member of another exemplary packaging article.

In the example of FIG. 6, the packaging member 10 includes object location and identification markings. Identification markings 16 can be employed to identify each of multiple packaged objects, e.g., using part numbers from a catalog or packing slip. Location markings 18 can guide placement of the objects 99 in the depressions 12 so that they are sufficiently aligned with the corresponding concavities 28 upon assembly of the packaging members 10 and 20. The markings can be realized in any suitable way, e.g., by molding, stamping, embossing, printing, writing, and so forth.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets of one or more features that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. A packaging article comprising:

a first packaging member having one or more depressions on a first surface thereof; and a second packaging member having one or more protrusions on a first surface thereof, wherein:

the first and second packaging members are arranged to be assembled together with their respective first surfaces facing one another and with each protrusion of the second packaging member at least partly received within a corresponding one of the one or more depressions of the first packaging member;

a transverse cross section of each depression is concave; and a transverse cross section, substantially parallel to the transverse cross section of the corresponding depression, of each protrusion includes a secondary protrusion, which secondary protrusion forms a ridge on the corresponding protrusion that extends along a first direction that is substantially orthogonal to the transverse cross section of the corresponding depression, wherein a cross section, substantially orthogonal to the transverse cross sections, of the ridge comprises a series of one or more concavities arranged along the first direction.

2. The packaging article of claim 1 wherein at least one of the one or more depressions and at least one of the one or more concavities of a corresponding one of the one or more protrusions are arranged so that a substantially rectangular object, received within the at least one of the one or more depressions and located between the first surfaces of the first and second packaging members assembled together, rests with two opposing edges of the object urged against the concave surface of the at least one of the one or more depressions with corresponding lines of contact oriented substantially along the first direction, and with two other opposing edges of the object urged against the at least one of the one or more concavities of the corresponding one of the one or more protrusions.

3. The packaging article of claim 2 wherein the first or second packaging member comprises a deformable packaging member arranged so as to deform upon urging the assembled first and second packaging members together with the object located and engaged between them.

4. The packaging article of claim 3 wherein the deformable packaging member comprises a resilient packaging member.

5. The packaging article of claim 2 further comprising a box bottom arranged to receive or retain the assembled first and second packaging members with the object located and engaged between them.

6. The packaging article of claim 5 further comprising a box lid arranged to enclose the assembled first and second packaging members received within the box bottom.

7. The packaging article of claim 1 wherein:

the first packaging member includes multiple depressions and the second packaging member includes multiple corresponding protrusions; or each corresponding ridge includes multiple concavities.

8. The packaging article of claim 1 wherein the first packaging member, the second packaging member, or both the first and second packaging members comprise a molded plastic sheet.

9. A method for making a packaging article, the method comprising:

forming a first packaging member with one or more depressions on a first surface thereof; and forming a second packaging member with one or more protrusions on a first surface thereof, wherein:

the first and second packaging members are arranged to be assembled together with their respective first surfaces facing one another and with each protrusion of the second packaging member at least partly received within a corresponding one of the one or more depressions of the first packaging member;

a transverse cross section of each depression is concave; and a transverse cross section, substantially parallel to the transverse cross section of the corresponding depression, of each protrusion includes a secondary protrusion, which secondary protrusion forms a ridge on the corresponding protrusion that extends along a first direction that is substantially orthogonal to the transverse cross section of the corresponding depression, wherein a cross section, substantially orthogonal to the transverse cross sections, of the ridge comprises a series of one or more concavities arranged along the first direction.

10. The method of claim 9 wherein at least one of the one or more depressions and at least one of the one or more concavities of a corresponding one of the one or more protrusions are arranged so that a substantially rectangular object, received within the at least one of the one or more depressions and located between the first surfaces of the first and second packaging members assembled together, rests with two opposing edges of the object urged against the concave surface of the at least one of the one or more depressions with corresponding lines of contact oriented substantially along the first direction, and with two other opposing edges of the object urged against the at least one of the one or more concavities of the corresponding one of the one or more protrusions.

11. The method of claim 10 wherein the first or second packaging member comprises a deformable packaging member arranged so as to deform upon urging the first and second packaging members together with the object located and engaged between them.

12. The method of claim 11 wherein the deformable packaging member comprises a resilient packaging member.

13. The method of claim 10 further comprising providing a box bottom arranged to receive or retain the assembled first and second packaging members with the object located and engaged between them.

14. The method of claim 13 further comprising providing a box lid arranged to enclose the assembled first and second packaging members received within the box bottom.

15. The method of claim 9 wherein:

the method further comprises forming multiple depressions on the first surface of the first packaging member and multiple corresponding protrusions on the first surface of the second packaging member; or each corresponding ridge includes multiple concavities.

16. The method of claim 9 wherein forming the first packaging member, the second packaging member, or both the first and second packaging members comprises molding a plastic sheet.

17. A method for using a packaging article, the method comprising:

placing a substantially rectangular object in a depression on a first surface of a first packaging member having one or more depressions on a first surface thereof; and assembling a second packaging member onto the first packaging member with a first surface of the second packaging member facing the first surface of the first packaging member, wherein the second packaging member has one or more protrusions on a first surface thereof, wherein:

the first and second packaging members are arranged so that, when assembled together with their respective first surfaces facing one another, each protrusion of the second packaging member is at least partly received within a corresponding one of the one or more depressions of the first packaging member;

a transverse cross section of each depression is concave;

a transverse cross section, substantially parallel to the transverse cross section of the corresponding depression, of each protrusion includes a secondary protrusion, which secondary protrusion forms a ridge on the corresponding protrusion that extends along a first direction that is substantially orthogonal to the transverse cross section of the corresponding depression, wherein a cross section of the ridge comprises a series of one or more concavities arranged along the first direction; and at least one of the one or more depressions and at least one of the one or more concavities of a corresponding one of the one or more protrusions are arranged so that the object rests with two opposing edges of the object urged against the concave surface of the at least one of the one or more depressions with corresponding lines of contact oriented substantially along the first direction, and with two other opposing edges of the object urged against the at least one of the one or more concavities of the corresponding one of the one or more protrusions.

18. The method of claim 17 wherein the first or second packaging member comprises a deformable packaging member arranged so as to deform upon urging the first and second packaging members together with the object located and engaged between them.

19. The method of claim 18 wherein the deformable packaging member comprises a resilient packaging member.

20. The method of claim 17 further comprising placing the assembled first and second packaging members, with the object located and engaged between them, in a box bottom arranged to receive or retain the assembled packaging members.

21. The method of claim 20 further comprising placing a box lid on the box bottom to enclose the assembled first and second packaging members received within the box bottom.

22. The method of claim 17 wherein:

the first packaging member includes multiple depressions and the second packaging member includes multiple corresponding protrusions; or each corresponding ridge includes multiple concavities.

23. The method of claim 17 wherein the first packaging member, the second packaging member, or both the first and second packaging members comprise a molded plastic sheet.

* * * * *